US010025229B2

(12) United States Patent
Matsuura

(10) Patent No.: US 10,025,229 B2
(45) Date of Patent: Jul. 17, 2018

(54) BELT UNIT, TRANSFER DEVICE, AND IMAGE FORMING APPARATUS

(71) Applicant: Hiroki Matsuura, Kanagawa (JP)

(72) Inventor: Hiroki Matsuura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/978,651

(22) Filed: Dec. 22, 2015

(65) Prior Publication Data

US 2016/0187818 A1 Jun. 30, 2016

(30) Foreign Application Priority Data

Dec. 26, 2014 (JP) ..... 2014-265334

(51) Int. Cl.
*G03G 15/16* (2006.01)
*G03G 21/16* (2006.01)

(52) U.S. Cl.
CPC ..... *G03G 15/1615* (2013.01); *G03G 21/1647* (2013.01)

(58) Field of Classification Search
CPC ..... G03G 15/1615
USPC ..... 399/121
See application file for complete search history.

(56) References Cited

U.S. PATENT DOCUMENTS

2007/0053726 A1* 3/2007 Noguchi ..... G03G 15/0126 399/298
2007/0286640 A1* 12/2007 Katoh ..... G03G 15/1615 399/121
2009/0087231 A1* 4/2009 Masaki ..... G03G 15/1615 399/308
2009/0297238 A1 12/2009 Matsuura et al.
2011/0206432 A1 8/2011 Ninomiya et al.
2011/0229195 A1 9/2011 Matsuura
2012/0237251 A1 9/2012 Matsuura et al.
2013/0051828 A1 2/2013 Yogosawa et al.
2013/0164049 A1* 6/2013 Kawanami ..... G03G 15/1615 399/302

FOREIGN PATENT DOCUMENTS

JP 8-108949 4/1996
JP 2007-298829 11/2007

* cited by examiner

*Primary Examiner* — Quana M Grainger
(74) *Attorney, Agent, or Firm* — Oblon, McClelland, Maier & Neustadt, L.L.P.

(57) ABSTRACT

A belt unit includes an endless belt, a plurality of support rotators, a pair of supports, and a stopper. The endless belt is wound around the plurality of support rotators. The pair of supports extend in a direction intersecting an axial direction of each of the plurality of support rotators. The pair of supports are disposed opposite to and spaced away from each other, to rotatably support both ends of each of the plurality of support rotators in the axial direction. The stopper is disposed at at least one end of at least one support rotator of the plurality of support rotators and outside from a corresponding one support of the pair of supports in the axial direction, to restrict movement of the corresponding one support in the axial direction.

19 Claims, 6 Drawing Sheets

BELT UNIT, TRANSFER DEVICE, AND IMAGE FORMING APPARATUS

CROSS-REFERENCE TO RELATED APPLICATIONS

This patent application is based on and claims priority pursuant to 35 U.S.C. § 119(a) to Japanese Patent Application No. 2014-265334, filed on Dec. 26, 2014, in the Japan Patent Office, the entire disclosure of which is incorporated by reference herein.

BACKGROUND

Technical Field

Aspects of the present disclosure relate to a belt unit, a transfer device, and an image forming apparatus.

Related Art

An image forming apparatus includes, for example, a transfer device as a belt unit including a transferer as an endless belt, a plurality of rollers as support rotators around which the transferer is wound, a pair of supports that extend in a direction intersecting the axial direction of the rollers and is disposed opposite to each other with a distance therebetween, an axial end and the other axial end of each roller being rotatably supported by a pair of supports.

SUMMARY

In an aspect of the present disclosure, there is provided a belt unit that includes an endless belt, a plurality of support rotators, a pair of supports, and a stopper. The endless belt is wound around the plurality of support rotators. The pair of supports extend in a direction intersecting an axial direction of each of the plurality of support rotators. The pair of supports are disposed opposite to and spaced away from each other, to rotatably support both ends of each of the plurality of support rotators in the axial direction. The stopper is disposed at at least one end of at least one support rotator of the plurality of support rotators and outside from a corresponding one support of the pair of supports in the axial direction, to restrict movement of the corresponding one support in the axial direction.

In another aspect of the present disclosure, there is provided a transfer device comprising the belt unit.

In still another aspect of the present disclosure, there is provided an image forming apparatus comprising the transfer device.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
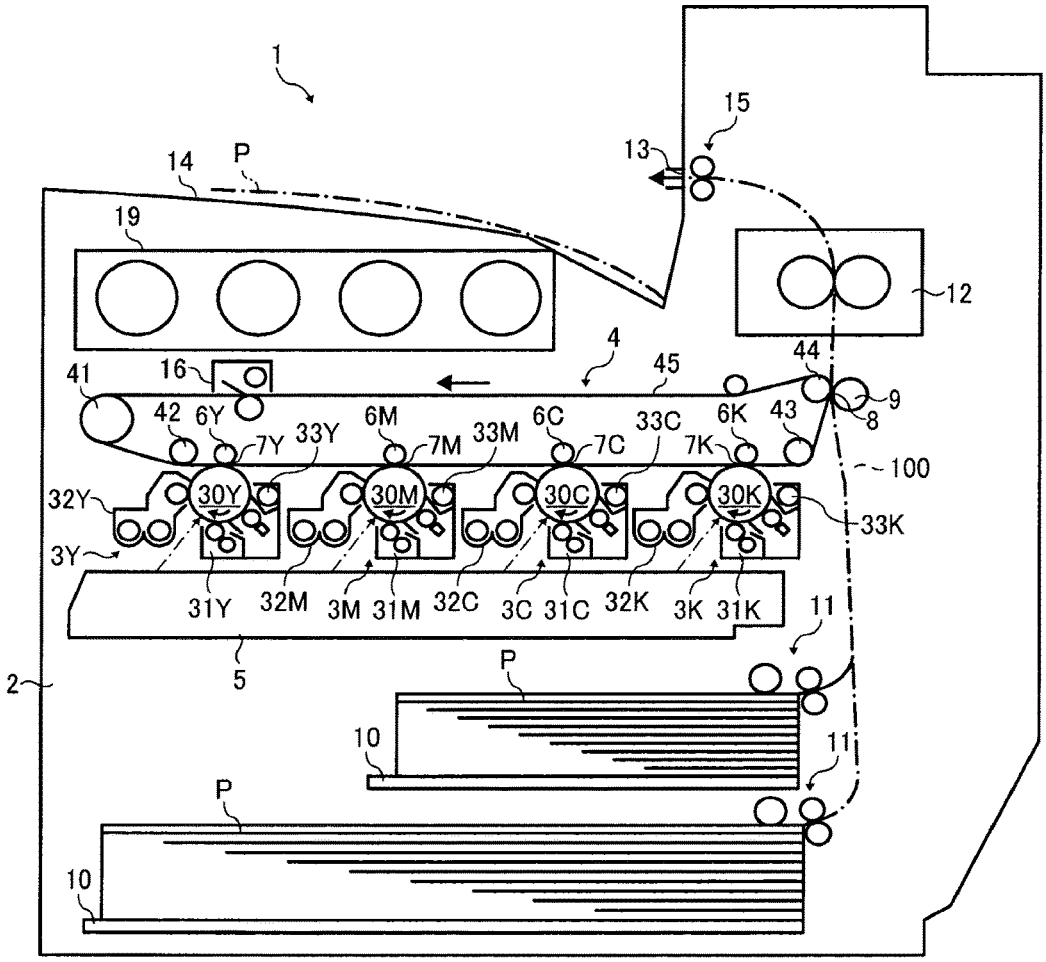
FIG. 1 is a schematic view of a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Embodiments according to the present disclosure will now be described in order referring to the drawings. FIG. 1 illustrates an image forming apparatus 1 according to an embodiment of the present disclosure. In FIG. 1, the image forming apparatus 1 is illustrated as a color printer employing a quadruple tandem intermediate transfer system to form a color image from four toners of yellow, magenta, cyan, and black. In FIG. 1, suffixes Y, M, C, K are appended to components respectively relating to colors of yellow, Magenta, cyan, and black. Fresh toner containers 19 each containing fresh toner of one color among the four colors are disposed at the front side of an upper portion of an apparatus body 2, which is a housing, of the image forming apparatus 1. Four process cartridge units 3Y, 3M, 3C, and 3K and an intermediate transfer unit 4 are disposed in substantially the middle of the apparatus body 2. The four process cartridge units 3Y, 3M, 3C, and 3K are image forming units, each of which forms a single color toner image from the corresponding toner among four colors of toner. The intermediate transfer unit 4 is a belt unit serving as a transfer device. The process cartridge units 3Y, 3M, 3C, and 3K are disposed below the intermediate transfer unit 4. An optical unit 5 serving as an exposure unit is disposed below the process cartridge units 3Y, 3M, 3C, and 3K.

The process cartridge units 3Y, 3M, 3C, and 3K include drum-shaped photoconductors 30Y, 30M, 30C, and 30K, respectively, as image bearers, on each of which an electrostatic latent image is formed by an exposing light emitted from the optical unit 5. The process cartridge units 3Y, 3M, 3C, and 3K respectively includes charging units 31Y, 31M, 31C, and 31K, developing units 32Y, 32M, 32C, and 32K, cleaning units 33Y, 33M, 33C, and 33K, and electric neutralization units. The charging unit, the developing unit, the cleaning unit, and the electric neutralization unit are disposed near corresponding one of the photoconductors 30Y, 30M, 30C, and 30K for each color. The process cartridge units 3Y, 3M, 3C, and 3K perform electrophotography processing using these units to respectively form single color toner images on the photoconductors 30Y, 30M, 30C, and 30K.

The intermediate transfer unit 4 includes a plurality of rollers 41, 42, 43, and 44, which are support rotators, and a transfer belt 45, which is an endless belt serving as a transferer wound around the rollers 41, 42, 43, and 44. The rollers 41 and 42 disposed at one side of the intermediate transfer unit 4 in the longitudinal direction of the intermediate transfer unit 4 indicated by arrow W in FIG. 2 (the left side in FIG. 2) and the roller 43 at the other side (the right side in FIG. 2) are driven rollers, and the roller 44 disposed above the roller 43 is a drive roller. The intermediate transfer unit 4 is configured such that, by rotationally driving the roller 44, the transfer belt 45 circulates counterclockwise in the FIG. 1 to convey recording materials. Primary transfer rollers 6Y, 6M, 6C, and 6K, which are primary transferers, are positioned in the inner side of the loop of the transfer belt 45 so as to respectively oppose the photoconductors 30Y, 30M, 30C, and 30K. The primary transfer rollers 6Y, 6M, 6C, and 6K press the transfer belt 45 toward the respective photoconductors 30Y, 30M, 30C, and 30K. Primary transfer sections 7Y, 7M, 7C, and 7K where toner images on the photoconductors are transferred to the transfer belt 45 are formed between the photoconductors 30Y, 30M, 30C, and 30K, respectively, and the transfer belt 45. A transfer bias for primary transfer is supplied to the primary transfer sections 7Y, 7M, 7C, and 7K. A secondary transfer section 8 is formed in the downstream of the primary transfer sections 7Y, 7M, 7C, and 7K in the conveyance direction of the belt. The secondary transfer section 8 is formed between a secondary transfer roller 9, which is a secondary transferer disposed so as to oppose the roller 44 and making contact with the transfer belt 45, and the transfer belt 45. A transfer bias for secondary transfer is supplied to the secondary transfer section 8.

A plurality of trays 10 storing recording materials P are provided below the optical unit 5. The recording materials P stored in the tray 10 are picked out from the tray 10 one at a time by a group of rollers 11 that picks out and sends the recording materials P, which is to be conveyed to the secondary transfer section 8. The toner images transferred onto the transfer belt 45 at the primary transfer sections 7Y, 7M, 7C, and 7K are transferred onto the recording material P at the secondary transfer section 8. The recording material P onto which the toner images has been transferred is conveyed to a fixing device 12 disposed in the downstream of the secondary transfer section 8 in the recording material conveyance direction. The recording material P is heated and pressed at the fixing device 12 to fix the toner image onto the recording material P, and then the recording material P is conveyed toward an ejection port 13. The recording material P conveyed to the ejection port 13 is ejected by a roller pair 15 and stacked on a sheet ejection tray 14 provided in the upper portion of the apparatus body 2. After finishing the transfer of the toner image, the transfer belt 45 is cleaned of untransferred toner and paper dust by a belt cleaning unit 16.

Figure 2:
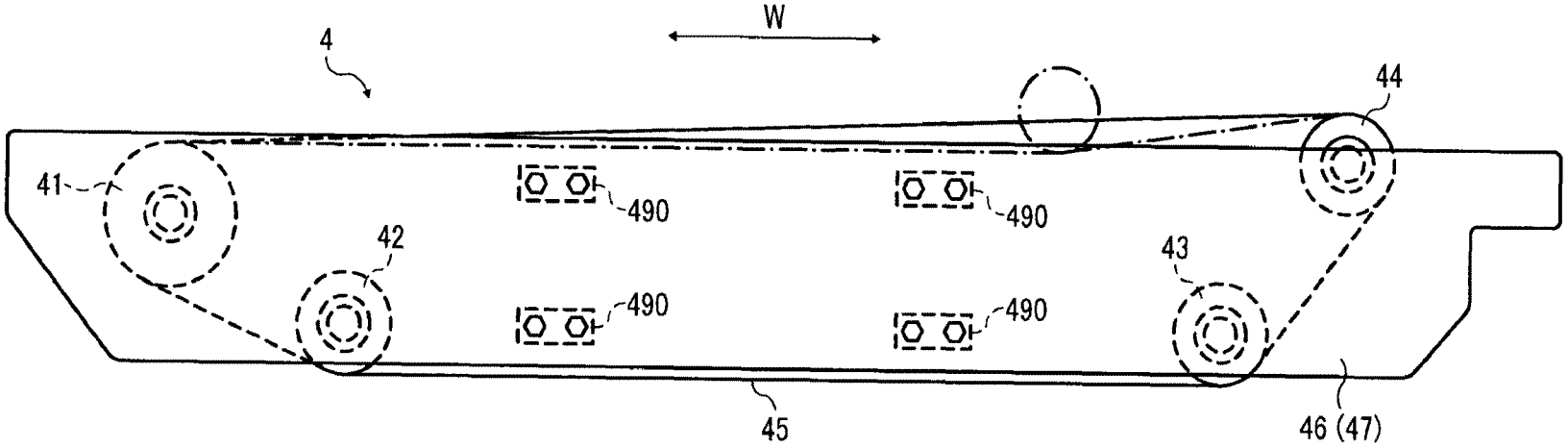
FIG. 2 is a front view of a transfer device as a belt unit used in the image forming apparatus of FIG. 1.
Figure 3:
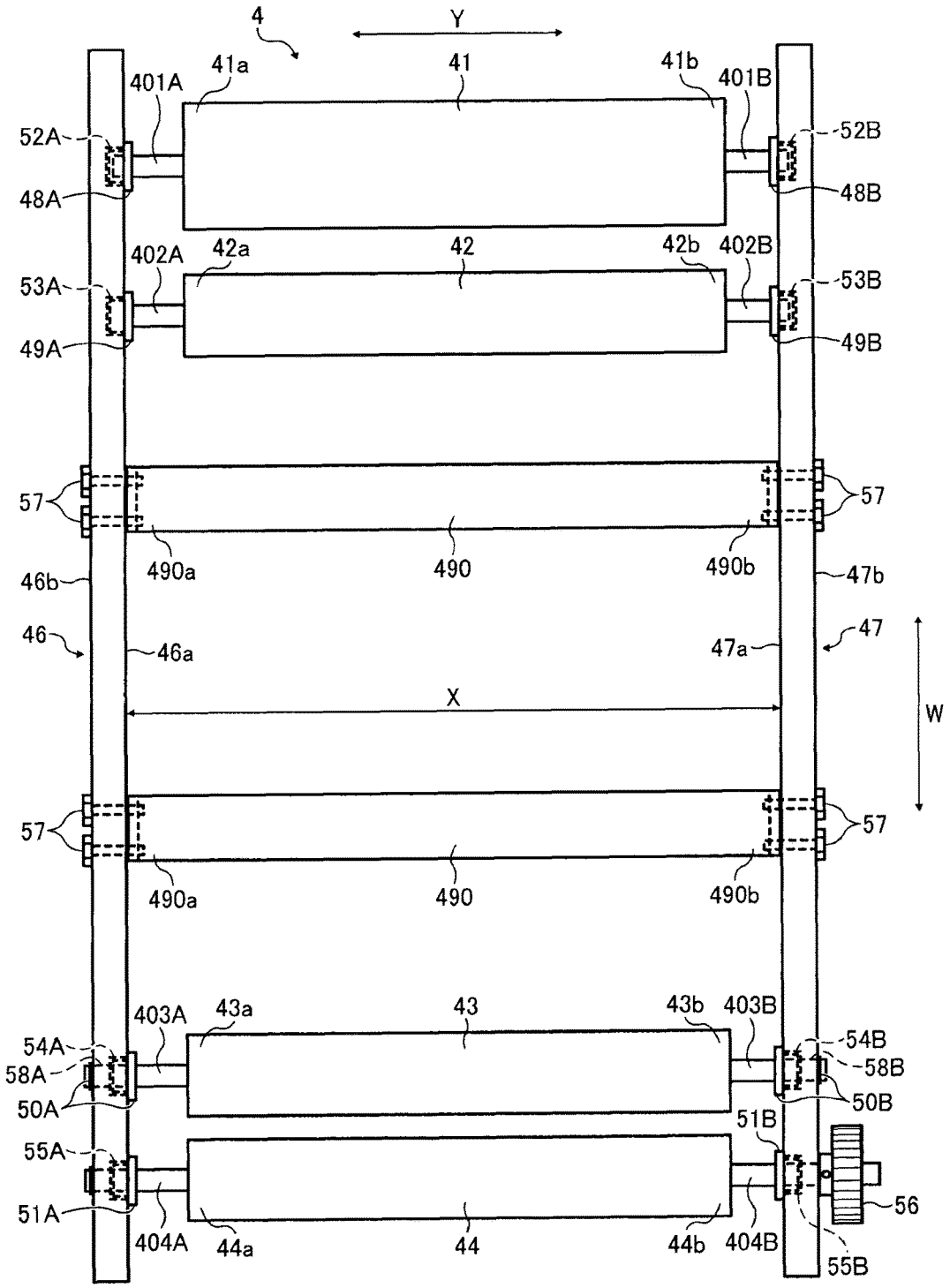
FIG. 3 is a plan view of the transfer device of FIG. 2.

The configuration of the intermediate transfer unit 4 will now be described using FIG. 2. The intermediate transfer unit 4 includes frame side plates 46 and 47, which are a pair of supports that rotatably support the rollers 41 to 44. The frame side plates 46 and 47 are made of resin and extend in a longitudinal direction W intersecting Y direction, which is the axial direction of the rollers 41 to 44. The frame side plates 46 and 47 are disposed opposite to and spaced away from each other in the axial direction Y. As illustrated in FIG. 3, the rollers 41, 42, 43, and 44 have ends 41*a*, 42*a*, 43*a*, and 44*a*, respectively, at one side in the axial direction Y, and ends 41*b*, 42*b*, 43*b*, and 44*b*, respectively, at the other side. Shafts 401A, 402A, 403A, and 404A project in the axial direction Y from the ends 41*a*, 42*a*, 43*a*, and 44*a*, respectively. Shafts 401B, 402B, 403B, and 404B project in the axial direction Y from the ends 41*b*, 42*b*, 43*b*, and 44*b*, respectively. Bearings 48A, 48B, 49A, 49B, 50A, 50B, 51A, and 51B are fixed to the shafts 401A, 401B, 402A, 402B, 403A, 403B, 404A, and 404B, respectively, by press fitting. A ball bearing is used in each of the bearings 48A, 48B, 49A, 49B, 50A, 50B, 51A, and 51B to reduce rotational resistance of the rollers 41 to 44. The primary transfer rollers 6Y, 6M, 6C, and 6K are also supported by the frame side plates 46 and 47.

Recessed portions 52A, 53A, 54A, and 55A, in which the bearings 48A, 49A, 50A, and 51A are respectively inserted, are provided on an inner face 46*a* of the frame side plate 46. Recessed portions 52B, 53B, 54B, and 55B, in which the bearings 48B, 49B, 50B, and 51B are respectively inserted, are provided on an inner face 47*a* of the frame side plate 47. The rollers 41, 42, 43, and 44 are disposed between the frame side plates 46 and 47 and are rotatably supported by the bearings 48A, 48B, 49A, 49B, 50A, 50B, 51A, and 51B respectively assembled in the recessed portions 52A, 52B, 53A, 53B, 54A, 54B, 55A, and 55B. As illustrated in FIG. 3, a drive gear 56 is fixed to the shaft 404B on an end of the roller 44, which is a drive roller, among the rollers 41 to 44. The drive gear 56 is provided in the outer side of the frame side plate 47 in the axial direction Y. A driving force is transmitted from a drive source to the drive gear 56.

A plurality of beams 490 serving as spacers are disposed between the frame side plate 46 and the frame side plate 47. In the longitudinal direction W, the beams 490 are positioned between the rollers 41 and 42 and the rollers 43 and 44. Both ends 490*a* and 490*b* in the axial direction Y of each beam 490 respectively abut inner faces 46*a* and 47*a* of the frame side plates 46 and 47. The ends 490*a* and 490*b* are fixed to the frame side plates 46 and 47 using fasteners 57, such as screws and bolts, so that the beams 490 maintain the distance X between the frame side plates 46 and 47 to be constant. In other words, the rollers 41 to 44 are disposed outside the range between the beams 490 in the longitudinal direction W of each of the frame side plates 46 and 47.

In this configuration, when the intermediate transfer unit 4 receives a strong shock or vibration during transportation, the frame side plates 46 and 47 are twisted and the distance X extends in the axial direction Y, which might cause the bearings 48A, 48B, 49A, 49B, 50A, 50B, 51A, and 51B to detach from the supports, thus resulting in fall of the rollers 41 to 44. This is particularly likely to happen for the driven rollers, of which shafts are not required to penetrate the frame side plates 46 and 47 in the axial direction Y. However, whether the driven rollers fall off depends on where the driven rollers are disposed.

For each of the three embodiments, a mechanism to prevent detachment of the bearing from the support, which causes the roller to fall, will now be described. The inventers has observed that, by giving a twist or vibration to the intermediate transfer unit 4 described above, the roller 43, among the driven rollers, falls from the frame side plates 46 and 47. The fall of the roller 43 may be explained as follows. The driven roller 43 is disposed closer to the drive roller 44 than the driven rollers 41 and 42. Under an unexpectedly large twist of the frame side plates 46 and 47, the distance X near the drive roller 44 is not likely to extend because the drive gear 56 is disposed in the axial direction Y outside the range including the frame side plates 46 and 47 and the shafts 404A and 404B are penetrating the frame side plates 46 and 47. Therefore, the twist of the frame side plates 46 and 47 is estimated to be large at the portion around the roller 43. The first to third embodiments each employing a mechanism to prevent fall of the roller 43 will now be described.

First Embodiment

Figure 4:
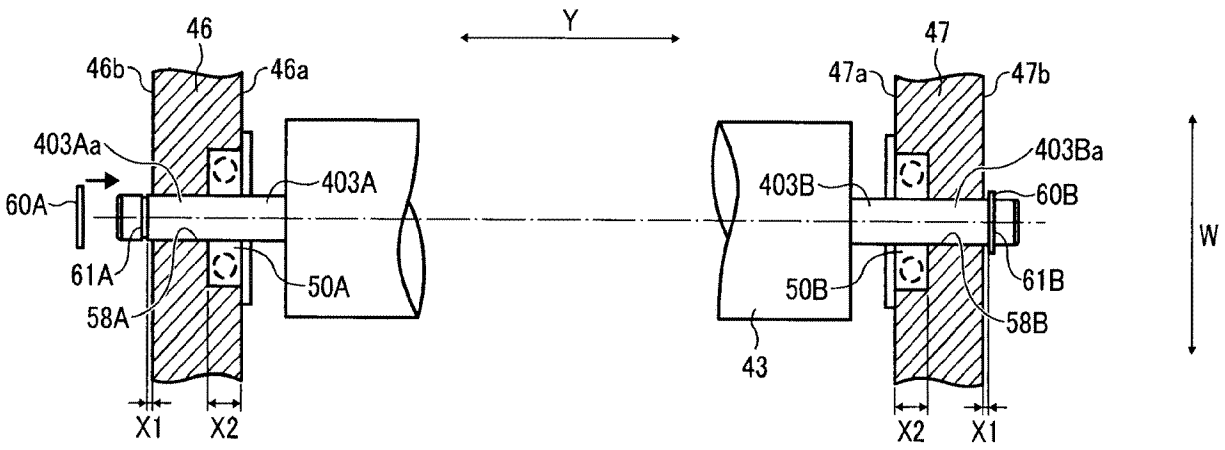
FIG. 4 is an enlarged sectional view of a configuration of preventing detachment of bearings and fall of a roller in a first embodiment of the present disclosure.

As illustrated in FIG. 4, an embodiment is configured such that shafts 403A and 403B of a driven roller 43 each has a sufficient length to penetrate frame side plates 46 or 47, and E-shape stopper rings (hereinafter referred to as E-rings) 60A and 60B, which are annular members serving as stoppers, are provided on ends 403Aa and 403Ba of the shafts 403A and 403B disposed in the axial direction Y outside the range including the frame side plates 46 and 47. Annular grooves 61A and 61B are provided on the outer circumferential faces of the ends 403Aa and 403Ba of the shafts 403A and 403B. The E-rings 60A and 60B are inserted in the grooves 61A and 61B from the outer circumferential sides to be attached. A distance X1 between the groove 61A and an outer face 46*b* of the frame side plate 46 and between the groove 61B and an outer face 47*b* of the frame side plate 47 is smaller than a depth (recessed amount) X2 of the recessed portion 54A from the inner face 46*a* and the recessed portion 54B from the inner face 47*a*.

In the embodiment, the metal E-rings 60A and 60B, which are annular members, are engaged and attached on the outer circumferential faces of the ends 403Aa and 403Ba of the shafts provided at the ends of the roller 43, where the E-rings 60A and 60B are disposed in the axial direction Y outside the range between the bearings 50A and 50B. That is, the bearing 50A and the E-ring 60A sandwich the frame side plate 46, and the bearing 50B and the E-ring 60B sandwich the frame side plate 47. In this manner, the roller 43 is supported by a pair of frame side plates 46 and 47, and at the same time, the movement of the frame side plates 46 and 47 in the axial direction Y are restricted by the bearings 50A and 50B and the E-rings 60A and 60B, serving as stoppers. In the embodiment, through holes 58A and 58B are provided in the recessed portions 54A and 54B, respectively, to penetrate the frame side plates 46 and 47, respectively, in the axial direction Y. The ends 403Aa and 403Ba of the shafts 403A and 403B project outside in the axial direction Y from the outer faces 46*b* and 47*b* of the frame side plates 46 and 47 through the through holes 58A and 58B, respectively.

In this configuration, the E-rings 60A and 60B hinder the frame side plates 46 and 47 from moving in the axial direction Y under unexpectedly large twist of the frame side plates 46 and 47. Accordingly, the distance X between the frame side plates 46 and 47 does not extend more than the depth (recessed amount) X2 of the recessed portions 54A and 54B, thereby preventing detachment of the bearings 50A and 50B from the recessed portions 54A and 54B. Such a configuration prevents fall of the roller 43 from the frame side plates 46 and 47. Moreover, since the E-rings 60A and 60B are used as the stoppers, the configuration has high versatility and thus the intermediate transfer unit 4 can be assembled with low cost.

Second Embodiment

Figure 5:
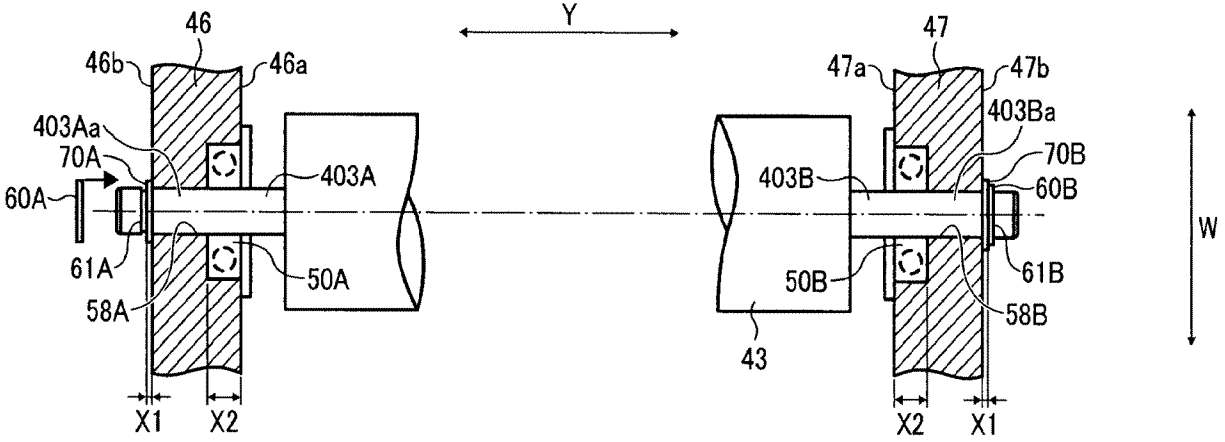
FIG. 5 is an enlarged sectional view of a configuration of preventing detachment of bearings and fall of a roller in a second embodiment of the present disclosure.

An embodiment illustrated in FIG. 5 is configured by adding slide members 70A and 70B to the first embodiment. The slide members 70A and 70B are annular members disposed respectively between the outer face 46*b* of the frame side plate 46 and the E-ring 60A and between the outer face 47*b* of the frame side plate 47 and the E-ring 60B. The slide members 70A and 70B are made of a resin having high slidability. When the shafts 403A and 403B or the frame side plates 46 and 47 move in the axial direction Y, the metal E-rings 60A and 60B directly contact the outer faces 46*b* and 47*b* of the frame side plates 46 and 47 made of resin. This contact, when a force acts in the axial direction Y, might cause abrasion of the outer faces 46*b* and 47*b* of the frame side plates 46 and 47 by the E-rings 60A and 60B. The abrasion might increase the amounts of backlash of the roller 43 and the frame side plates 46 and 47 in the axial direction Y.

In the embodiment, resin-made slide members 70A and 70B are disposed respectively between the outer face 46*b* of the frame side plate 46 and the E-ring 60A and between the outer face 47*b* of the frame side plate 47 and the E-ring 60B. That is, the embodiment is configured such that the roller 43 is supported by a pair of frame side plates 46 and 47, movements of the frame side plates 46 and 47 in the axial direction Y are restricted by the bearings 50A and 50B and the E-rings 60A and 60B, serving as stoppers, and the slide members 70A and 70B are disposed respectively between the frame side plate 46 and the E-ring 60A and between the frame side plate 47 and the E-ring 60B.

This configuration prevents the direct contact between the E-ring 60A and the outer face 46*b* as well as the direct contact between the E-ring 60B and the outer face 47*b*, thereby reducing abrasion. Thus, the wear caused by the friction between the frame side plate 46 and the fastener, or E-ring 60A, and between the frame side plate 47 and the fastener, or E-ring 60B, produced by rotation of the roller 43 can be prevented. Such a configuration prevents the frame side plates 46 and 47 from shifting in the axial direction Y with an elapsed time, thus more reliably preventing detachment of the bearings 50A and 50B and fall of the roller 43.

Third Embodiment

Figure 6:
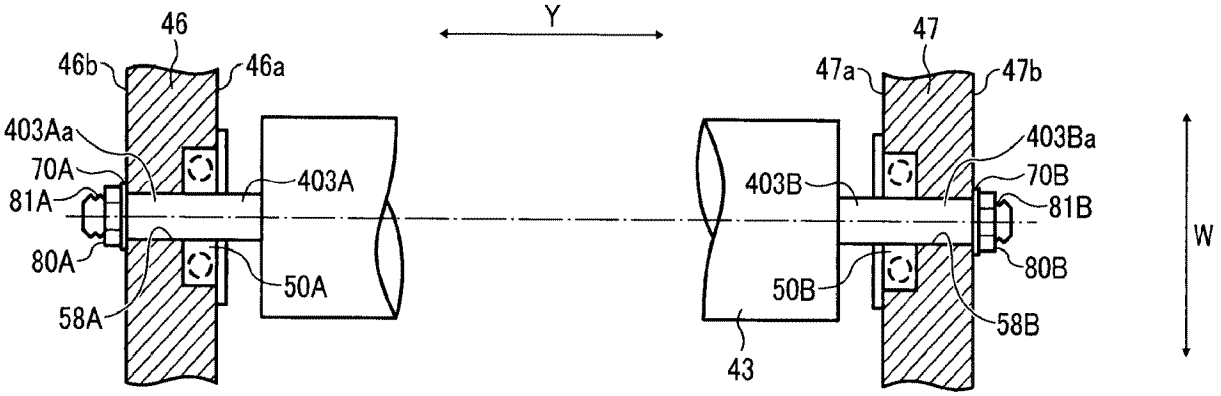
FIG. 6 is an enlarged sectional view of a configuration of preventing detachment of bearings and fall of a roller in a third embodiment of the present disclosure.

An embodiment illustrated in FIG. 6 includes fasteners 80A and 80B in place of the E-rings 60A and 60B as stoppers that restrict the movement of the frame side plates 46 and 47 in the axial direction Y. The embodiment is configured such that external threads 81A and 81B are respectively provided on the outer circumferential faces of the ends 403Aa and 403Ba of the shafts 403A and 403B of the roller 43 as thread portions, instead of annular grooves, which are provided in the axial direction Y outside the region including the outer faces 46*b* and 47*b* of the frame side plates 46 and 47. The fasteners 80A and 80B, such as nuts, are screwed onto the external threads 81A and 81B, respectively, to restrict the movement of the frame side plates 46 and 47 in the axial direction Y. The embodiment also includes the slide members 70A and 70B described in the second embodiment and disposed respectively between the fastener 80A and the outer face 46*b* and between the fastener 80B and the outer face 47*b* to avoid direct contact. That is, the embodiment is configured such that the roller 43 is supported by a pair of frame side plates 46 and 47, movements of the frame side plates 46 and 47 in the axial direction Y are restricted by the bearings 50A and 50B and the fasteners 80A and 80B, serving as stoppers, and the slide members 70A and 70B are respectively disposed between the frame side plate 46 and the fastener 80A and between the frame side plate 47 and the fastener 80B.

This configuration prevents the direct contact between the fasteners 80A and the outer face 46*b* as well as the direct contact between the fastener 80B and the outer face 47*b*, thereby minimizing abrasion. Thus, the wear caused by the friction between the frame side plate 46 and the fastener 80A and between the frame side plate 47 and the fastener 80B produced by rotation of the roller 43 can be prevented. Such a configuration prevents the frame side plates 46 and 47 from shifting in the axial direction Y with an elapsed time, thus more reliably preventing detachment of the bearings 50A and 50B and fall of the roller 43. Furthermore, the embodiment is preferably smaller in the amount of backlash is and more unlikely to fall due to shock and vibration than that of the embodiment including the E-rings 60A and 60B, thereby more reliably preventing detachment of the bearings 50A and 50B and fall of the roller 43.

The slide members 70A and 70B described in the second and third embodiments are made of resin material having high slidability. For example, Polyslider Washer manufactured by Asahi Polyslider Co., Ltd., or SW-01 and NW-02 made of duracon resin manufactured by Polyplastics Co., Ltd can be used as the slide member 70. The slide members 70A and 70B are not limited to the above-described particular members. For example, a material having the coefficient of friction of 0.3 or less against stainless steel may be disposed between the stopper, that is, the E-ring 60A or the fastener 80A, and the outer face 46*b* of the frame side plate 46 and between the stopper, that is, the E-ring 60B or the fastener 80B, and the outer face 47*b* of the frame side plate 47.

Figure 7:
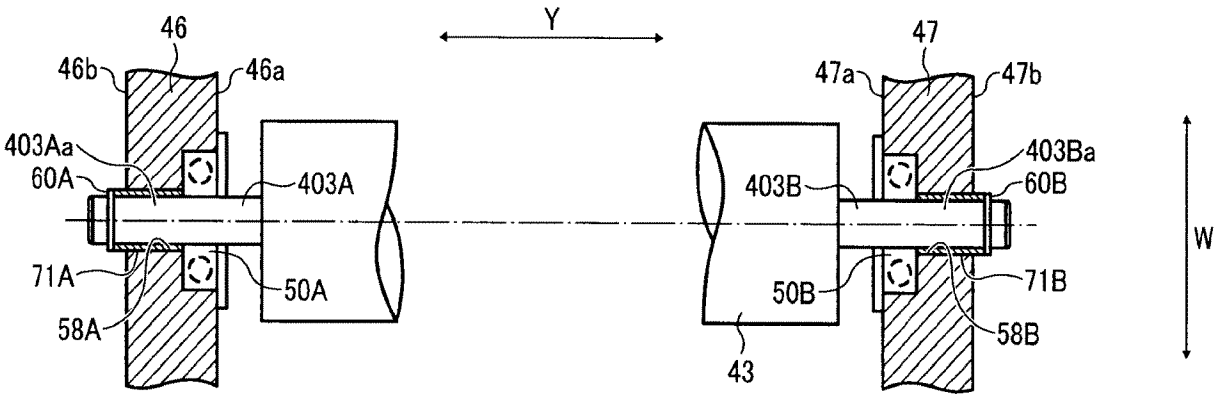
FIG. 7 is an enlarged sectional view of a variation of the second embodiment.
Figure 8:
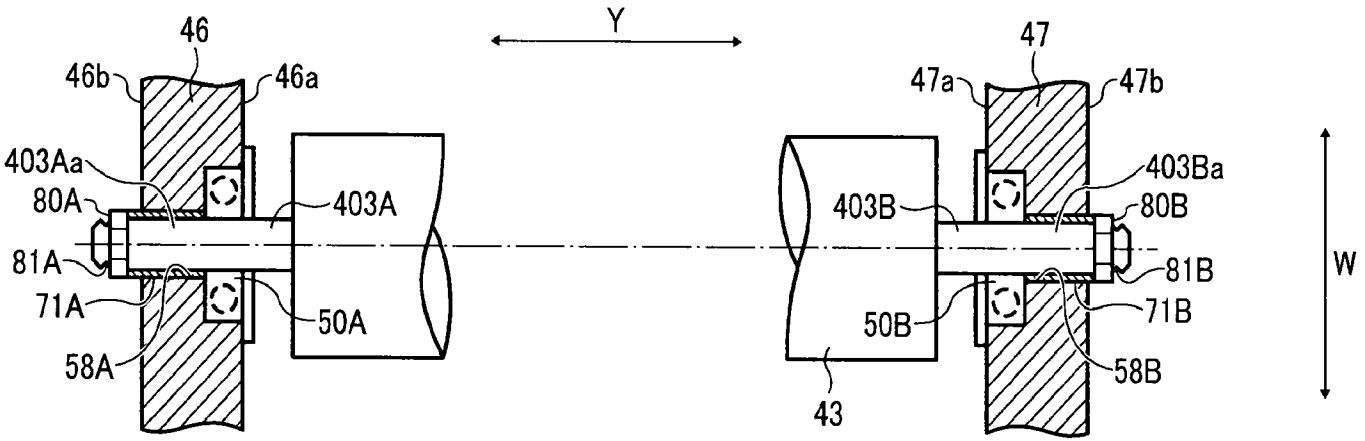
FIG. 8 is an enlarged sectional view of a variation of the third embodiment.

The slide members 70A and 70B each having an annular shape are preferable, because the slide members 70A and 70B can easily be disposed by insertion in the ends 403Aa and 403Ba of the shafts 403A and 403B. Alternatively, as in exemplary modifications illustrated in FIGS. 7 and 8, sleeve-shaped collars 71A and 71B may previously be inserted in the through holes 58A and 58B provided in the frame side plates 46 and 47 to allow the ends 403Aa and 403Ba of the shafts 403A and 403B to penetrate the frame side plates 46 and 47. The collars 71A and 71B prevent the outer faces 46*b* and 47*b* from contacting the E-rings 60A and 60B or the fasteners 80A and 80B.

Several preferable embodiments of the present disclosure are described above though, the present disclosure is not limited to those particular embodiments. Unless specifically limited in the above description, various modifications and alterations can be made without departing from the scope and spirit of the present disclosure described in the claims. For example, the image forming apparatus is not limited to a color printer, but may be a copier, a fax machine, a plotter printer, or a multifunction peripheral combining a scanner and at least one of a printer, a fax machine, a plotter printer, and a copier.

In the embodiments described above, the E-rings 60A and 60B or the fasteners 80A and 80B are used at both ends of the roller 43. Alternatively, the E-rings or the fasteners may be used only at either end of the roller 43, depending on an amount of extension of the distance between the frame side plates 46 and 47. In the embodiments described above, the E-rings 60A and 60B or the fasteners 80A and 80B, which serve as stoppers, are used for a mechanism to prevent fall of the roller 43, among a plurality of rollers. It goes without saying that the mechanism may be used for other driven rollers 41 and 42. In the embodiments described above, the unit layout is such that the process cartridge units 3Y, 3M, 3C, and 3K are disposed below the intermediate transfer unit 4, and the primary transfer sections 7Y, 7M, 7C, and 7K are formed in the lower portion of the intermediate transfer unit 4. The present disclosure may also be used in a unit layout such that the process cartridge units 3Y, 3M, 3C, and 3K are disposed above the intermediate transfer unit 4, and the primary transfer sections 7Y, 7M, 7C, and 7K are formed in the upper portion of the intermediate transfer unit 4.

In the embodiments described above, the apparatus transfers images from the transfer belt 45 to the recording material P (the apparatus is an image forming apparatus employing the intermediate transfer method). Alternatively, the present disclosure can also be applied to an apparatus that directly transfers images from an image bearer, such as a drum-shaped or belt type photoconductor, to the recording material P (an image forming apparatus employing the direct transfer method). In the embodiments described above, the recording material P is conveyed in the horizontal direction through the transfer section (the primary transfer section). Alternatively, the present disclosure may be applied to an image forming apparatus that conveys the recording material P in other directions, for example, upward, downward, obliquely upward, or obliquely downward through the transfer section (the primary transfer section). That is, regarding an apparatus employing the intermediate transfer method, the present disclosure can be applied to a unit layout in which the intermediate transfer unit 4 is disposed so as the transfer belt 45 runs in the vertical direction and the process cartridge units 3Y, 3M, 3C, and 3K are disposed to the right or left of the intermediate transfer unit 4 so that the primary transfer sections 7Y, 7M, 7C, and 7K are formed in the right or left portion of the intermediate transfer unit 4. Alternatively, the present disclosure may be applied to a unit layout in which the intermediate transfer unit 4 is disposed so as the transfer belt 45 runs in an oblique direction and the process cartridge units 3Y, 3M, 3C, and 3K are disposed in a relative position to the intermediate transfer unit 4 to form the primary transfer sections 7Y, 7M, 7C, and 7K in the right, left, upper oblique, or lower oblique portion of the intermediate transfer unit 4.

In the embodiments described above, the intermediate transfer unit 4 as a belt unit includes the plurality of rollers 41, 42, 43, and 44, which are support rotators, and the transfer belt 45, which is an endless belt serving as a transferer wound around the rollers 41, 42, 43, and 44. Alternatively, the present disclosure may be applied to a belt unit that includes an endless belt, such as the transfer belt 45; a support rotator, such as the roller 41, 42, 43, or 44, around which the endless belt is wound; a pair of supports, such as the frame side plates 46 and 47, extending in a direction intersecting an axial direction of the support rotator, the pair of supports disposed opposite to and spaced away from each other, to rotatably support both ends of the support rotator in the axial direction; and a stopper, such as the E-rings 60A and 60B, disposed at at least one end of the support rotator and outside from a corresponding one support of the pair of supports in the axial direction, to restrict movement of the corresponding one support in the axial direction.

The described effects of the embodiments of the present disclosure are merely examples of the most preferable effect obtained by the embodiments of the present disclosure. The effect of the embodiment of the present disclosure is not limited to the effects of the embodiments described above.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A belt unit, comprising:

an endless belt;

a plurality of support rotators around which the endless belt is wound;

a pair of supports extending in a direction intersecting an axial direction of each of the plurality of support rotators, the pair of supports disposed opposite to and spaced away from each other, to rotatably support both ends of each of the plurality of support rotators in the axial direction;

a stopper disposed at at least one end of at least one support rotator of the plurality of support rotators and outside from a corresponding one support of the pair of supports in the axial direction, to restrict movement of the corresponding one support in the axial direction; and a slide member disposed between the stopper and the corresponding one support of the pair of supports.

2. The belt unit according to claim 1, further comprising a plurality of spacers disposed between the pair of supports with both axial ends of the plurality of spacers fixed to the pair of supports to maintain a distance between the pair of supports.

3. The belt unit according to claim 2, wherein the at least one support rotator with the stopper is disposed outside a range between the plurality of spacers in a longitudinal direction of the pair of supports.

4. The belt unit according to claim 1, wherein the at least one support rotator with the stopper is a driven roller.

5. The belt unit according to claim 1, wherein the stopper is an annular member engaging an outer circumferential face of the at least one end of the at least one support rotator.

6. The belt unit according to claim 1, further comprising a thread on an outer circumferential face of the at least one end of the at least one support rotator;

wherein the stopper is a fastener screwed onto the thread.

7. The belt unit according to claim 1, wherein the slide member is made of a resin having high slidability.

8. The belt unit according to claim 1, further comprising bearings, wherein both ends of the at least one support rotator with the stopper in the axial direction are rotatably supported by the pair of supports via the bearings.

9. The belt unit according to claim 8, wherein the bearings are ball bearings.

10. A transfer device comprising the belt unit according to claim 1.

11. The transfer device according to claim 10, wherein the endless belt is a transferer onto which an image is to be transferred, the plurality of support rotators are a drive roller and a driven roller around which the transferer is wound, and the pair of supports is a pair of frame side plates assembled to a body of an image forming apparatus.

12. An image forming apparatus comprising the transfer device according to claim 10.

13. The image forming apparatus according to claim 12, further comprising an image bearer to bear an image thereon, wherein the endless belt is a transferer onto which an image is to be transferred, and the transferer is disposed opposite to the image bearer.

14. A belt unit, comprising:

an endless belt;

a support rotator around which the endless belt is wound;

a bearing;

a pair of supports extending in a direction intersecting an axial direction of the support rotator, the pair of supports disposed opposite to and spaced away from each other, to rotatably support both ends of the support rotator in the axial direction, at least one support of the pair of supports including a recessed portion into which the bearing is inserted;

a stopper disposed directly on at at least one end of a shaft of the support rotator and outside from the at least one support that is a corresponding one support of the pair of supports in the axial direction, to restrict an outward movement of the corresponding one support in the axial direction, wherein $X1<X2$, where $X1$ is a maximum distance between the stopper and the at least one support, and $X2$ is a depth of the recessed portion; and a slide member disposed between the stopper and an outer face of the at least one support.

15. The belt unit according to claim 1, wherein the stopper includes a pair of stoppers disposed on both ends of at least one support rotator of the plurality of support rotators in the axial direction, and the pair of stoppers restricts an increase of a distance between the pair of supports in the axial direction.

16. The belt unit according to claim 5, wherein the annular member is an E-ring.

17. The belt unit according to claim 1, wherein the stopper includes a pair of stoppers disposed on both ends of at least one support rotator of the plurality of support rotators in the axial direction, and the pair of stoppers restricts an increase of a distance between the pair of supports in the axial direction.

18. The belt unit according to claim 1, wherein the stopper includes a pair of stoppers, the slide member includes a pair of slide members, one slide member of the pair of slide members is disposed between one stopper of the pair of stoppers and one support of the pair of supports, and the other slide member of the pair of slide members is disposed between the other stopper of the pair of stoppers and the other support of the pair of supports.

19. The belt unit according to claim 1, wherein the pair of supports extends in a longitudinal direction (W), and a drive roller and a driven roller are disposed on a same side in the longitudinal direction (W).

* * * * *